US005448345A

United States Patent [19]

Uto et al.

[11] Patent Number: 5,448,345

[45] Date of Patent: Sep. 5, 1995

[54] SHEET ORIGINAL CONVEYING APPARATUS AND IMAGE FORMING APPARATUS WITH IT

[75] Inventors: Nobutaka Uto, Yokohama; Masataka Naito, Kawasaki, both of Japan

[73] Assignee: Canon Kabushiki Kaisha, Tokyo, Japan

[21] Appl. No.: 972,288

[22] Filed: Nov. 5, 1992

[30] Foreign Application Priority Data

Nov. 8, 1991 [JP] Japan ..... 3-319749

[51] Int. Cl.[6] ..... G03G 21/00

[52] U.S. Cl. ..... 355/308; 226/29; 226/178; 355/209

[58] Field of Search ..... 355/308, 309, 205, 206, 355/207, 48, 50, 235, 234, 209, 316; 226/1, 2, 24, 29, 42, 178, 43, 74; 493/320, 410; 270/39

[56] References Cited

U.S. PATENT DOCUMENTS

| | | | |
|---|---|---|---|
| 4,488,670 | 12/1984 | Godshalk et al. | 355/308 X |
| 4,494,855 | 1/1985 | Colwill | 355/48 X |
| 4,607,948 | 8/1986 | Naito . | |
| 4,627,709 | 12/1986 | Kitajima et al. . | |
| 4,761,001 | 8/1988 | Hayakawa et al. . | |
| 5,187,532 | 2/1993 | McNew | 355/309 X |
| 5,192,977 | 3/1993 | Kaneko et al. | 355/309 X |
| 5,230,454 | 7/1993 | Nonaka et al. | 226/29 X |

FOREIGN PATENT DOCUMENTS

| | | |
|---|---|---|
| 57-166253 | 10/1982 | Japan . |
| 59-67070 | 4/1984 | Japan . |
| 61-05261 | 1/1986 | Japan . |
| 1-286873 | 11/1989 | Japan . |
| 3-107876 | 5/1991 | Japan . |
| 3-227878 | 10/1991 | Japan . |
| 4-027966 | 1/1992 | Japan . |
| 4-182165 | 6/1992 | Japan . |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

A sheet original conveying apparatus conveys a sheet original to a reading position where an image on the sheet original is read. The apparatus have a conveying device for intermittently conveying the sheet original so that images on the sheet original may be read while conveying the sheet original without stopping the sheet original on a platen, and control device for controlling the conveying device to convey the sheet original in such a manner that convey intervals for an initial several pages of the sheet original become greater than a normal convey interval for the remaining pages of the original sheet.

20 Claims, 12 Drawing Sheets

FIG. 2A
FIG. 2
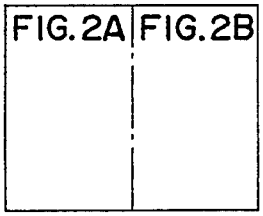
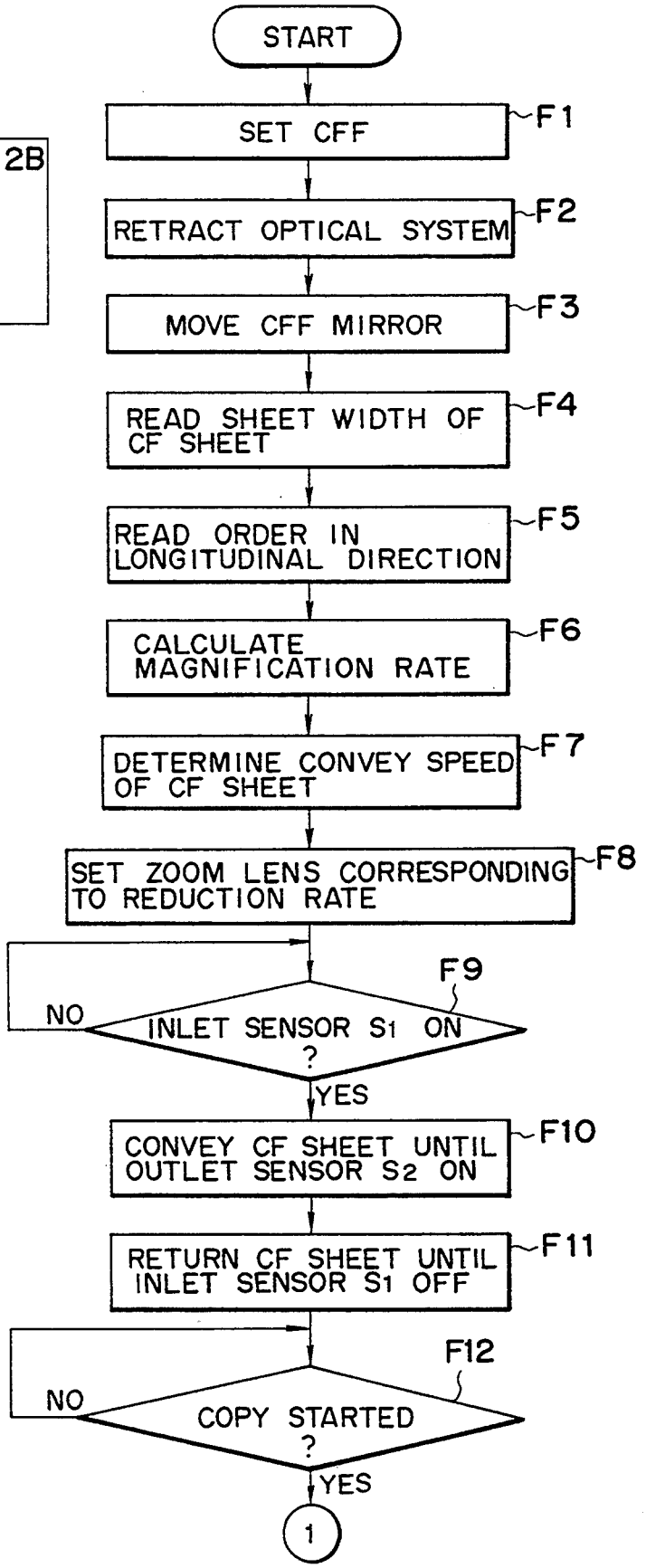

SHEET ORIGINAL CONVEYING APPARATUS AND IMAGE FORMING APPARATUS WITH IT

BACKGROUND OF THE INVENTION

1. Field of the Invention

The present invention relates to a sheet original conveying apparatus and an image forming apparatus having such a sheet original conveying apparatus. More particularly, it relates to a sheet original conveying apparatus effective to feed, for example, a continuous sheet including folds therein, such as a computer form (referred to as "CF sheet" hereinafter), as an original to be read. However, the original is not limited to such a continuous sheet; the sheet original conveying apparatus can be applied to successively convey short cut sheet originals.

2. Related Background Art

In the past, various sheet original conveying apparatuses for handling a continuous sheet such as a CF sheet as an original have been developed and put to practical use. In such apparatuses, generally, the reading of an original and the image formation were performed at a constant speed from beginning to end.

However, in such conventional apparatuses, and particularly in the case of a high speed system, since the reading of the original and the ejection of copy sheets were performed at a high speed, if the image density of the original was extremely thin, thereby generating a poor copy, or if the setting of the copy density was improper, thereby generating a poor copy, then it was feared that a large number of erroneous copies would generated before an operator became aware of the existence of the poor copy.

On the other hand, particularly in a case where a CF sheet was used as an original, when the CF sheet was conveyed at a high speed, since the CF sheet was continuously sent to an ejection tray in succession, before the read CF sheet could be correctly folded on the ejection tray, it was feared that the CF sheet might be damaged.

SUMMARY OF THE INVENTION

An object of the present invention is to provide a sheet conveying apparatus and an image forming apparatus which can eliminate the above-mentioned conventional drawbacks, prevent poor folding or stacking and damage of a read sheet original, reduce erroneous copies and improve the reliability of the apparatus.

A typical means for eliminating the above-mentioned conventional drawbacks, which can be applied to embodiments described later, is to feed a length of a sheet original corresponding to an initial several pages at a page-to-page interval (pitch) longer than that for feeding of the remaining sheet original to be normally read. Alternatively feeding of the sheet original may be stopped by interposing a "pause" on the way.

With this arrangement, when the continuous sheet original is read, since the initial several pages of the sheet original are fed at a longer conveying pitch or are stopped by interposing a pause, it is possible to obtain sufficient time for checking images formed on the recording sheets, and to allow latitude in time during which the folding habit or characteristic correction can be applied to the sheet original.

BRIEF DESCRIPTION OF THE DRAWINGS

FIG. 2, 2A, and 2B are a flow chart showing an image forming operation of the image forming apparatus;

DETAILED DESCRIPTION OF THE PREFERRED EMBODIMENTS

The present invention will now be explained in connection with an embodiment of an image forming apparatus to which the present invention is applied with reference to FIGS. 1 to 10. In this embodiment, the image forming apparatus is as a copying machine.

Figure 1:
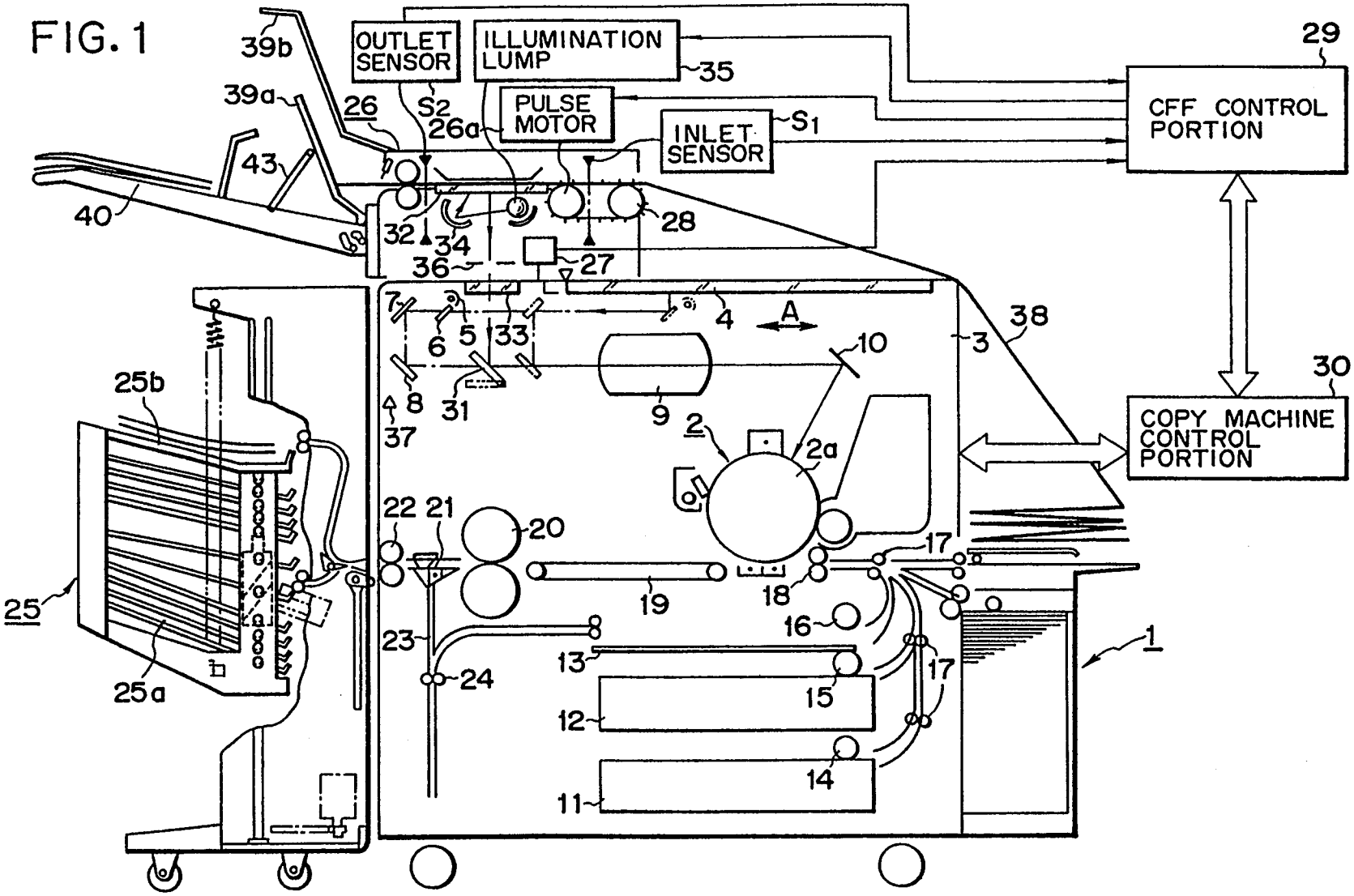
FIG. 1 is schematic sectional view showing a construction of a copying machine as an example of an image forming apparatus according to a preferred embodiment of the invention.
Figure 2B:
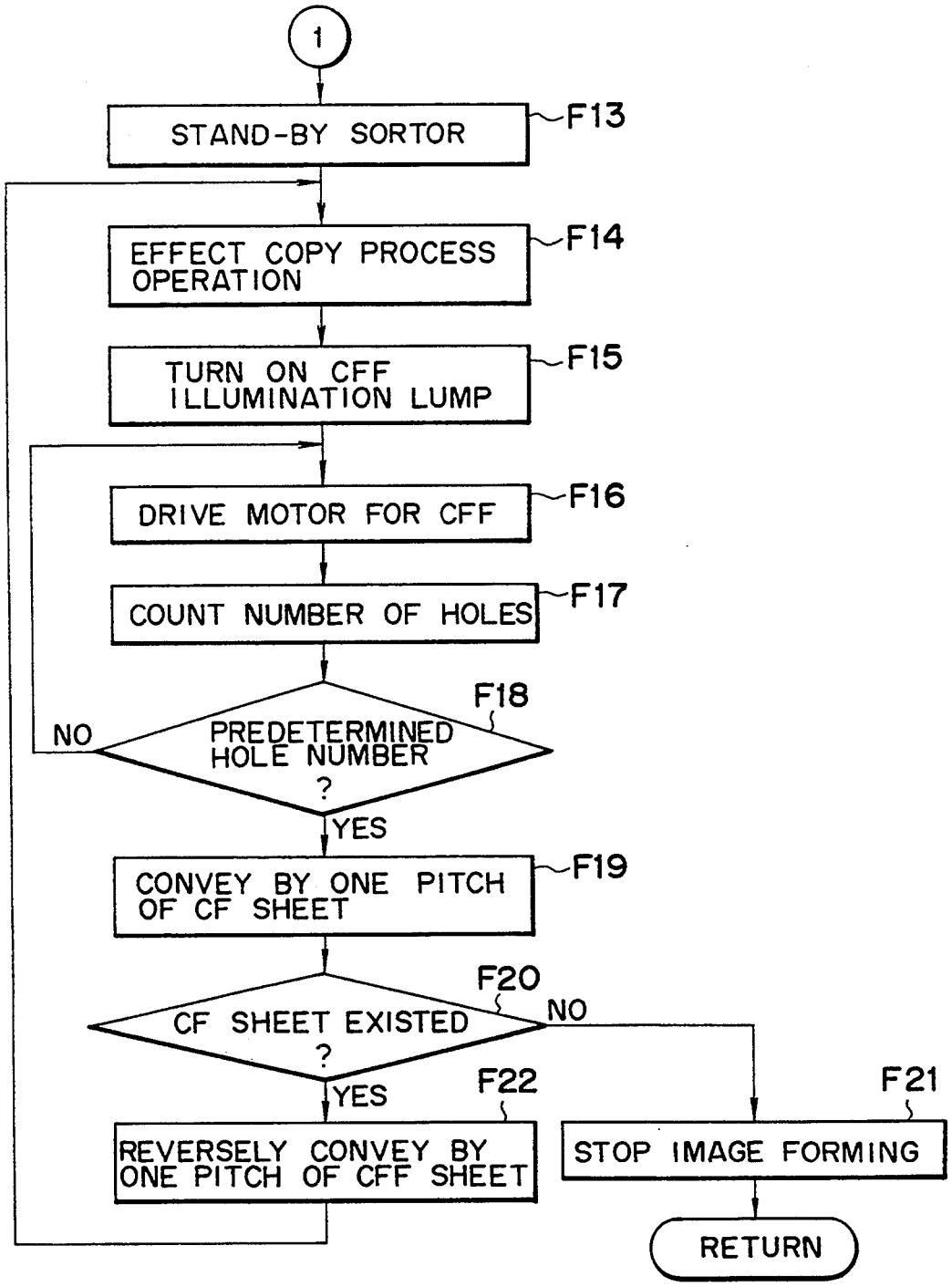
Figure 3:
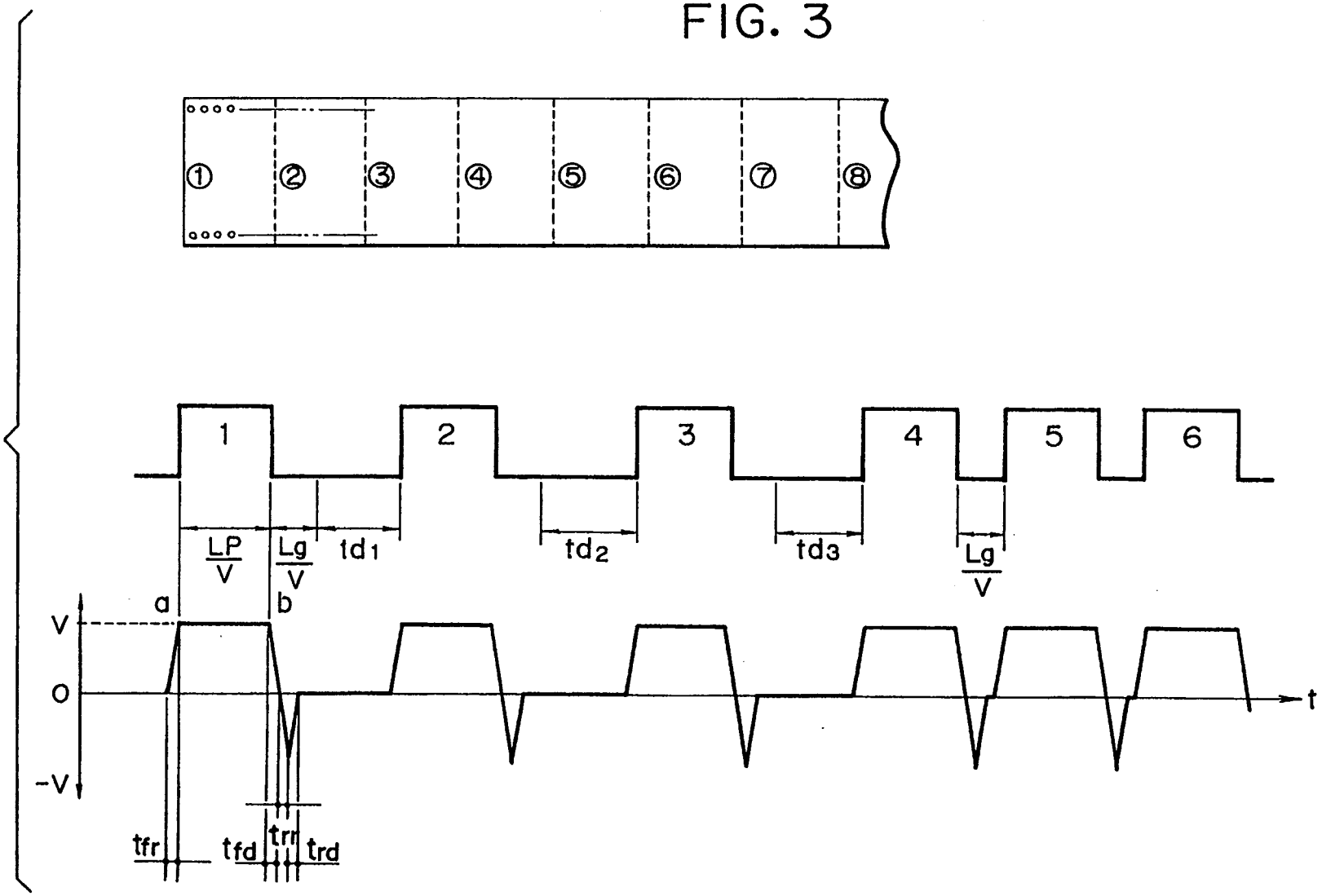
FIG. 3 is a view showing a speed distribution of the movement of an original.
Figure 4:
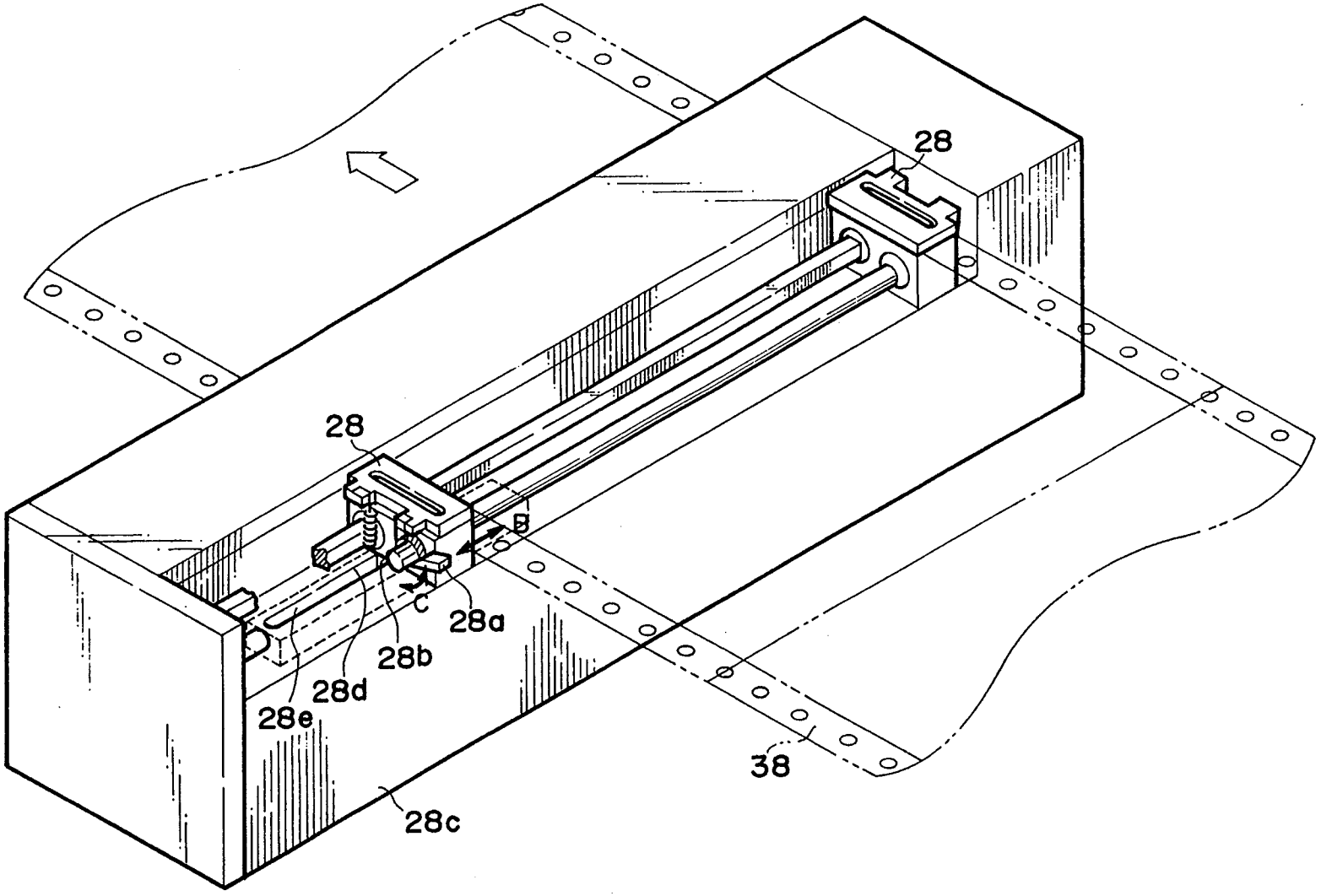
FIG. 4 is a perspective view of a computer form feeder.
Figure 5:
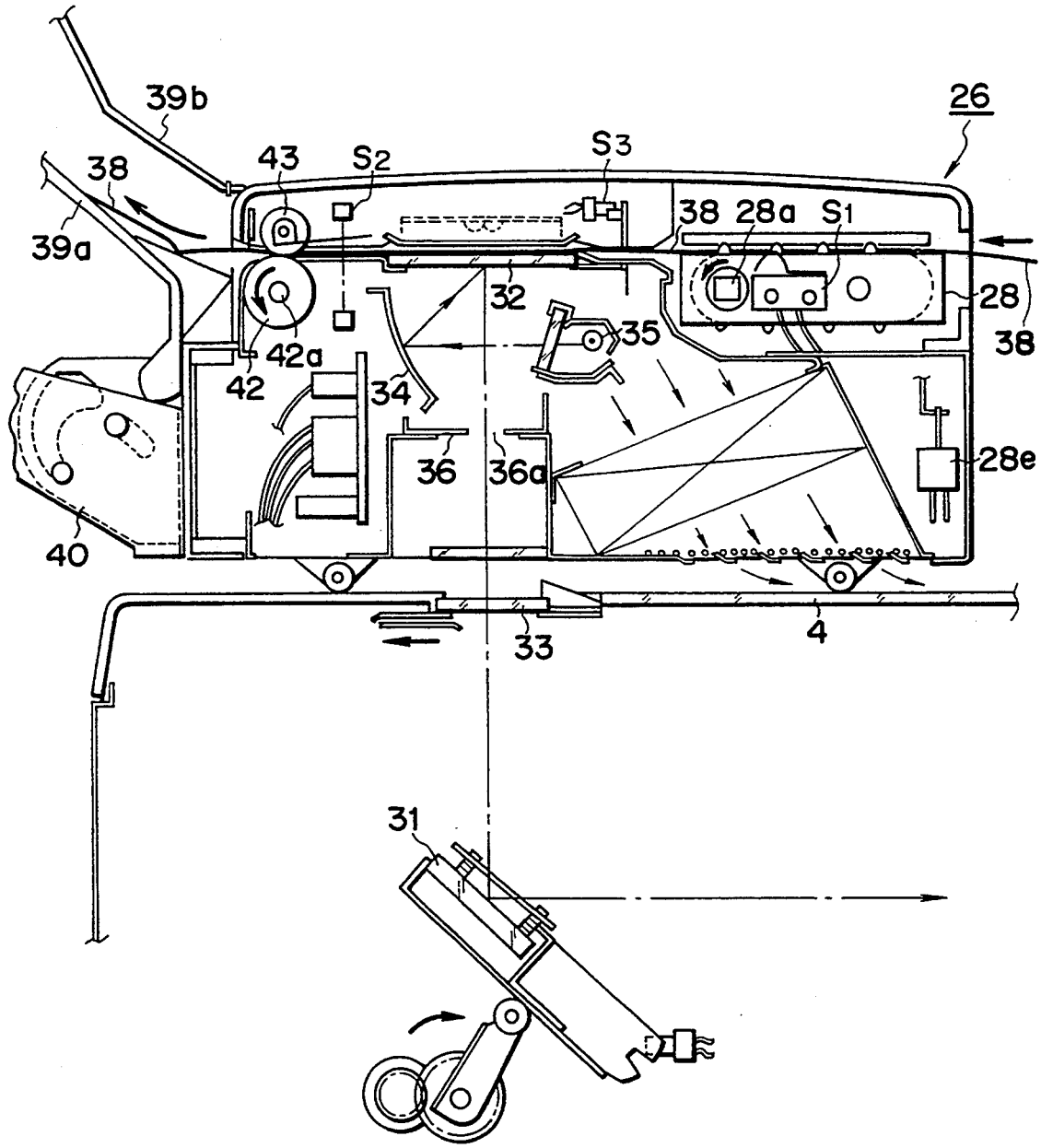
FIG. 5 is a sectional view showing a conveying movement of a CF sheet.
Figure 6:
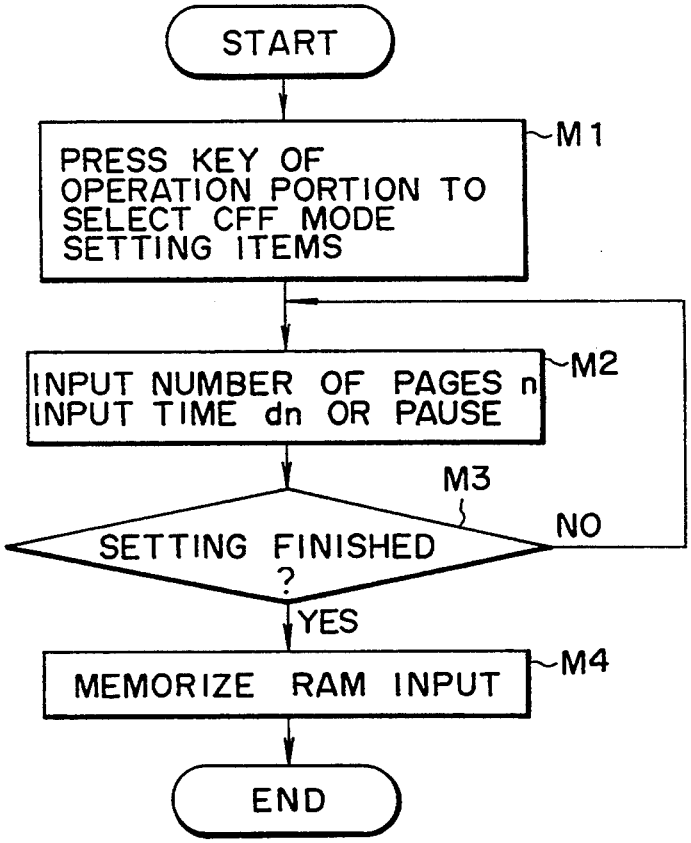
FIG. 6 is a flow chart showing an input operation for the time delay.
Figure 7:
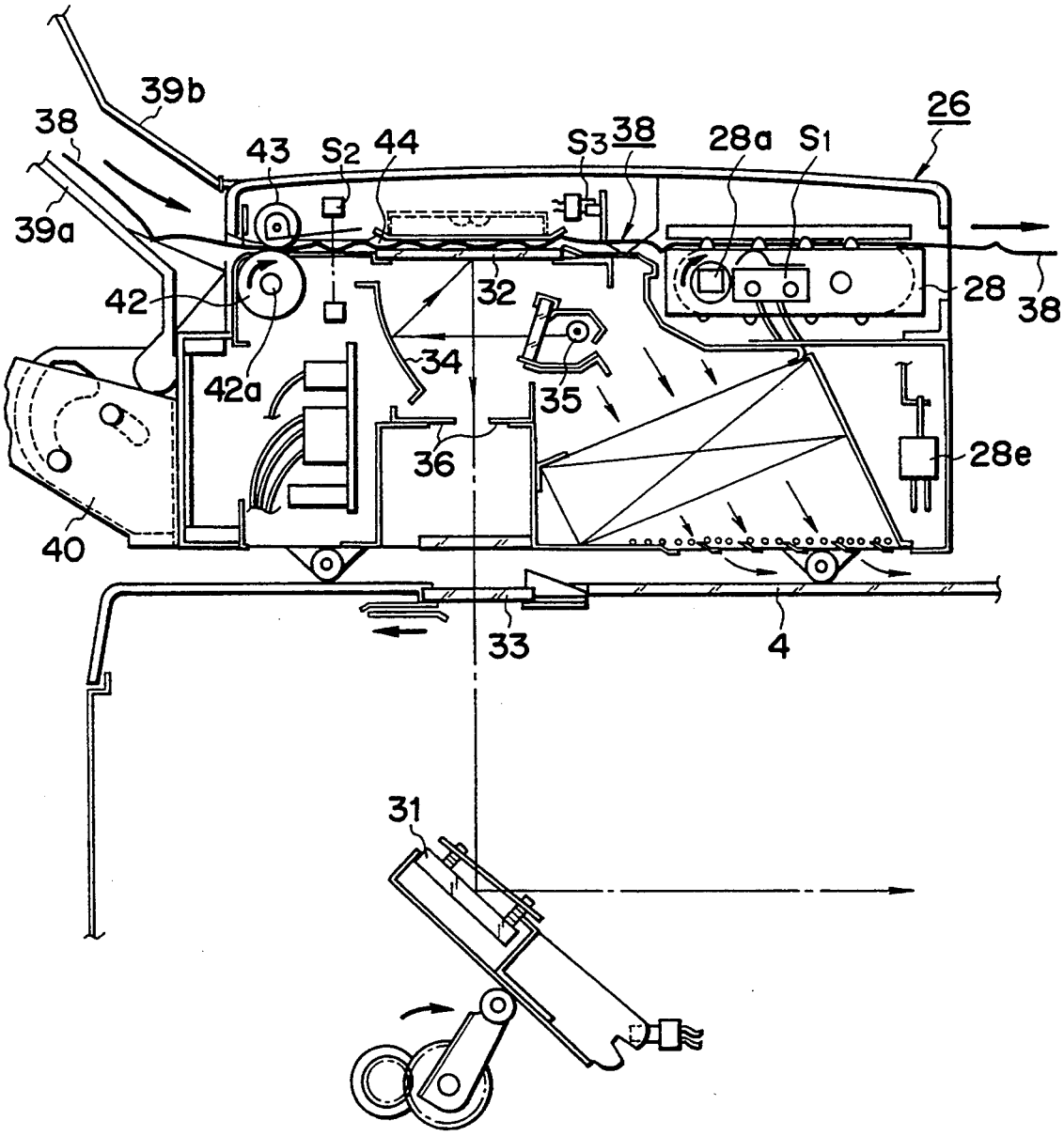
FIG. 7 is a sectional view showing a conveying movement of a CF sheet in another case.
Figure 8:
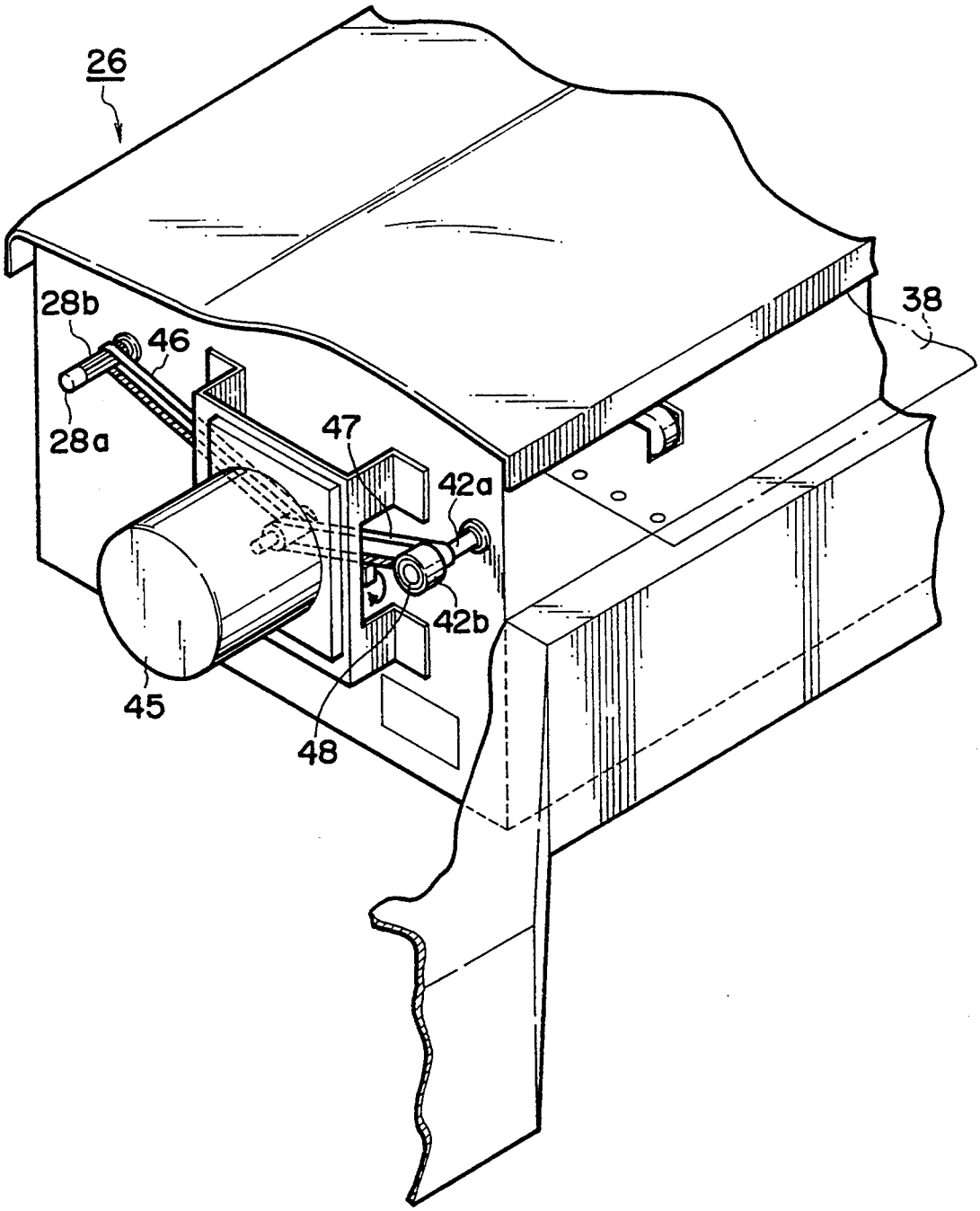
FIG. 8 is a perspective view of a drive mechanism of the computer form feeder.
Figure 9:
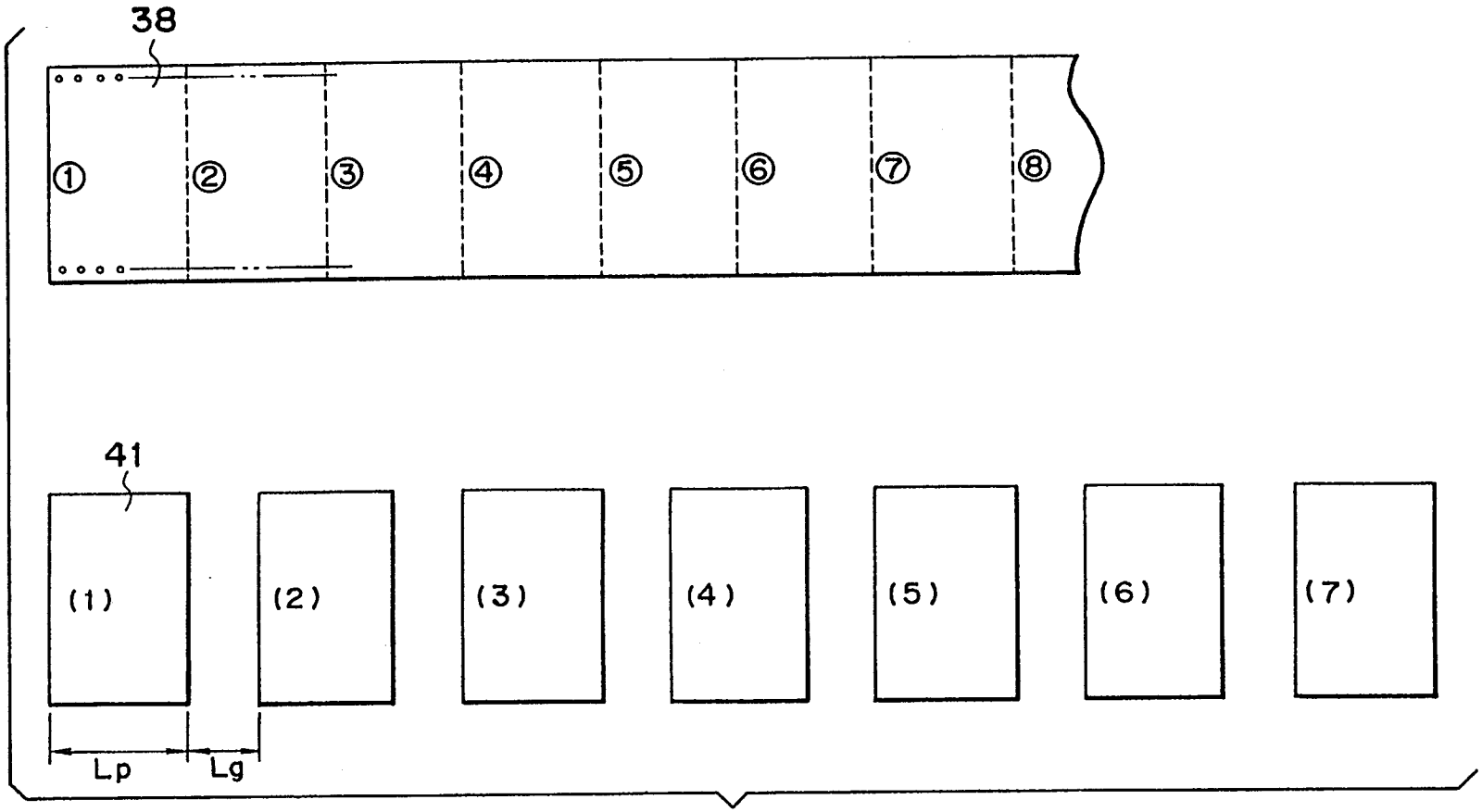
FIG. 9 is a view showing a corresponding relation between a continuous sheet original and cut sheet originals.
Figure 10:
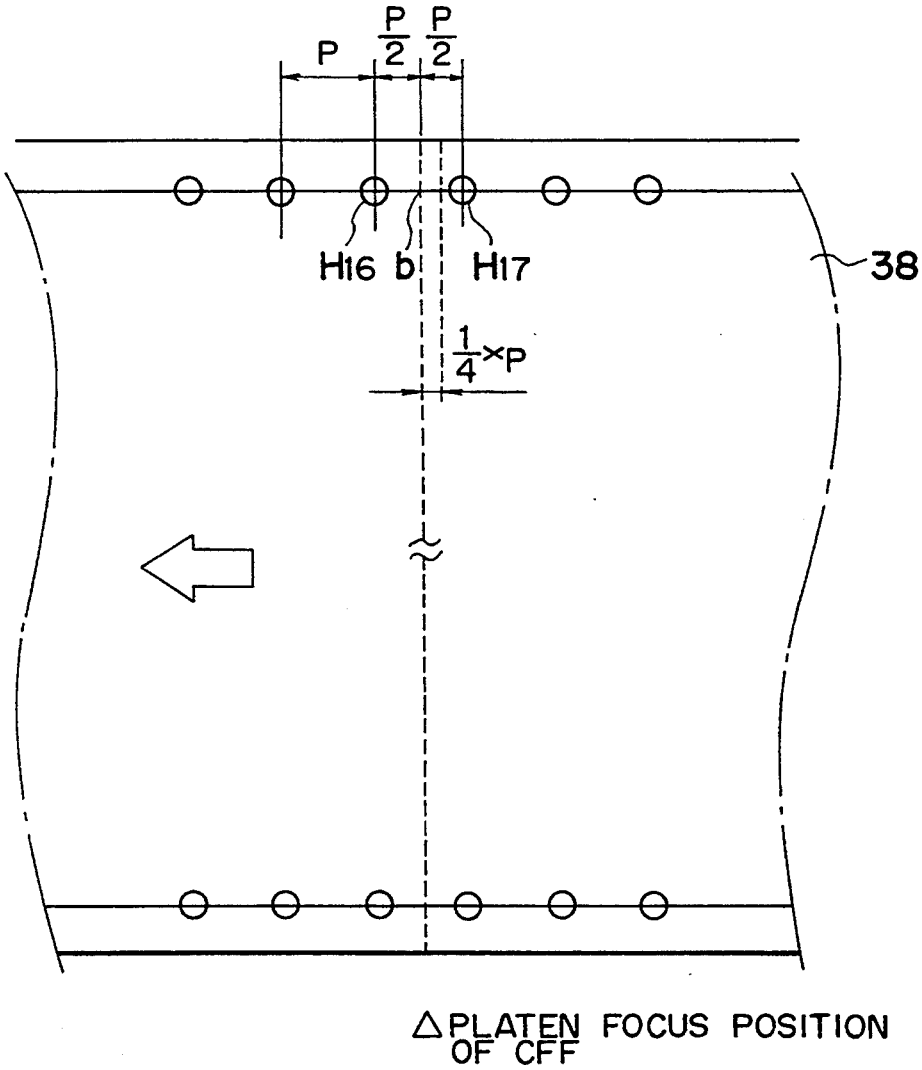
FIG. 10 is a partial view of the CF sheet.

FIG. 1 is a schematic view showing a construction of a copying machine, FIG. 2 is a flow chart showing an image forming operation of the copying machine, FIG. 3 is a view showing a speed distribution of an original, FIG. 4 is a perspective view of a computer form feeder (CFF), FIG. 5 is a sectional view showing a conveying movement of a CF sheet, FIG. 6 is a flow chart showing an input operation for the time delay, FIG. 7 is a sectional view showing a conveying movement of a CF sheet in another case, FIG. 8 is a perspective view of a drive mechanism of the computer form feeder, FIG. 9 is a view showing a corresponding relation between a continuous sheet original and cut sheet originals, FIG. 10 is a partial view of the CF sheet.

First of all, the general construction copying machine will be explained with reference to FIG. 1. The copying machine 1 has a machine body 3 containing therein a copying station 2 for performing image formation by a conventional electrophotographic process. Normally, a sheet original is set on a first glass platen 4 and is fixed by a pressure cover or an automatic original conveying apparatus (not shown, but refer e.g., to U.S. Pat. No. 4,761,001) or is read at a glance, as disclosed in U.S. Pat. No. 4,627,709.

A light source 5 for exposing the original illuminates the original, and the light reflected by the original is reflected by first, second and third mirrors 6, 7, 8, respectively, and passes through a zoom lens 9. Then, the light is reflected by a fourth mirror 10 and is focused on a photosensitive drum 2*a* in the copying station 2. In a case where the original is fixed, the first mirror 6 is reciprocally translated together with the light source 5 in directions shown by the arrow A to scan the original. The second and third mirrors 7, 8 are arranged on a same mirror carriage in an inverted V-shaped fashion and are translated at a speed of a half (½) of the translating speed of the first mirror 6 in the directions A to establish a predetermined length of a light path.

Next, the machine body 3 will be described in connection with a movement of a transfer sheet on which an image is to be formed. Within a lower portion of the machine body 3, there are arranged cassettes 11, 12 for containing the transfer sheet therein, and an intermediate tray 13 for storing transfer sheets on which an image has been formed on one side, re-feeding such transfer sheets, in registration with each other in a vertical direction. Sheet supply rollers 14, 15, 16 are disposed above the cassettes 11, 12 and the intermediate tray 13, respectively. Convey rollers 17 are disposed at a downstream side of the sheet supply rollers 14, 15, 16, and a pair of register rollers 18 are disposed at a downstream side of the convey rollers 17.

At a downstream side of the register rollers 18, there are sequentially arranged the copying station 2, a convey belt 19 and a fixing device 20. A flapper 21 for changing an advancing direction of the transfer sheet and a pair of ejector rollers 22 are disposed at a downstream side of the fixing device 20. The flapper 21 is driven in a two-sided copying mode to direct the transfer sheet to a convey path 23, whereby the transfer sheet is switched back by a pair of convey rollers 24 to eject and store the transfer sheet on the intermediate tray 13. In a multi-copying mode, the transfer sheet is switched back by the pair of ejector rollers 22 to be directed to the convey path 23 and then is ejected and stored on the intermediate tray 13. The transfer sheets stored on the intermediate tray 13 are separated and fed one by one by the sheet supply roller 16 to the copying station 2. Thereafter, the transfer sheet is passed through the fixing device 20 and then is ejected by the ejector rollers 22 in a sorter 25 having a plurality of sorter bins 25*a*.

An automatic document feeding apparatus (ADF) and a computer form feeder (referred to as "CFF" hereinafter) 26 are mounted on the copying machine 1. When the ADF is used, the CFF 26 is retracted to a stand-by position; whereas, when the CFF 26 is used, the ADF is retracted to a stand-by position. When the CFF 26 is used, the original is continuously fed and continuously scanned.

Now, the construction of the CFF 26 will be described with reference to FIGS. 1 and 5. First it is determined, by a joint switch 27, whether the CFF 26 is set on the copying machine 1. A CF sheet as a sheet original is normally a continuous sheet having folds and is provided at both its lateral edges with a series of sprocket holes. An operator sets the CF sheet 38 by engaging the sprocket holes of the sheet with pins of a pin feed tractor (first convey means) 28. The pin feed tractor 28 is rotatably driven by a pulse motor 26*a* to convey the CF sheet 38.

When the copying machine 1 detects, by the joint switch 27, the fact that the CFF 26 is set, a detection signal from the switch is sent to a CFF control portion 29 which in turn sends a signal to a copying machine control portion 30. The copying machine control portion 30 controls the first, second and third mirrors 6, 7, 8 to position them in a home position. Then, a CFF mirror 31 in the body 3 of the machine is shifted from a first condition (retracted position) shown by broken lines to a second condition (operative position) shown by solid lines. In this way, the machine is changed from a fixed internal reading mode to a continuous reading mode.

The positional relation between a second glass platen 32, CFF mirror 31 and zoom lens 9 which constitute an exposure station for the CFF 26 is selected so that a light path from the first glass platen 4 to the zoom lens 9 through the first, second and third mirrors 6, 7, 8 in the fixed reading mode is equal to a light path from the second glass platen 32 to the zoom lens 9 via a window 33 and the CFF mirror 31 in the continuous reading mode.

As shown in FIG. 5, below the second glass platen 32, there are arranged a reflector 34, a halogen lamp 35 and a slit plate 36 having a slit 36*a*. When the original to be scanned is fixed on the first glass platen 4, the CFF mirror 31 is retracted to the position shown by the broken line in FIG. 1 so as not to interfere with the optical system of the machine. On the other hand, when the original is continuously scanned while moving across the second glass plate 32, the CFF mirror 31 is pivoted to the position shown by the solid line in FIG. 1. In this case, the positions of the first, second and third mirrors 6, 7, 8 are controlled so that they do not block the light path, i.e., the third mirror 8 is retracted to a position across a sensor 37 in the machine body 3. Due to an accident or mal-function such as the damage of a cable, even if the group of mirrors are moved in a condition that the CFF mirror 31 is in the operative position, it is designed so that the CFF mirror 31 is mechanically shifted to the retracted position.

Further, at a downstream side of the CFF 26, there are arranged an original convey roller 42 and a pressure roller 43 which constitute a second convey means. The original convey roller 42 is rotatably driven by a driving force from a drive source described later, and a conveying speed of the CF sheet 38 is selected so as to be slightly greater than that of the pin feed tractor 28.

An inlet sensor S1 and an outlet sensor S2 are provided for detecting the CF sheet 38. After the CF sheet 38 conveyed by the pin feed tractor 28 and the original convey roller 42 is read, it is guided by guide members 39*a*, 39*b* to be ejected onto an ejection tray 40.

Next, an original supplying operation effected when the CFF 26 is used will be explained with reference to a flow chart shown in FIG. 2, and FIGS. 3 to 10. First of all, the CFF 26 is set on the copying machine 1 (F1). As mentioned above, when the fact that the CFF 26 has been set is detected by the joint switch 27, the optical system including the first mirror 6 and the like is retracted to the home position (F2). When the fact that the third mirror 8 has been returned to the stand-by position is detected by the sensor 37, the CFF mirror 31 is moved up to the position shown by the solid line in FIG. 1 (F3).

As shown in FIG. 4, the pin feed tractor 28 is movable in a widthwise direction (direction shown by the arrow B) so that, when the lever 28*a* is rotated in directions shown by the arrow C, the pin feed tractor can be locked or unlocked. A size detection lever 28*b* for detecting a size of the CF sheet 38 is attached to a lower portion of the pin feed tractor 28. The size detection lever 28*b* is connected to a slide volume 28*e* through a circular groove 28*d* formed in a cover 28*c* disposed directly below the pin feed tractor 28 so that it can detect or read a sheet width of the CF sheet 38 (F4).

Then, the number of holes per page of the CF sheet 38 is detected. This may be effected by a system in which the operator can input information. An example for detecting the number of holes is as follows. Since a dotted line or fold line is formed in the CF sheet between one page and the next page, the CF sheet repeats a "top" and a "bottom" page. When the number of sprocket holes between one top and the next top is previously counted for each of several pages of the CF sheet by a page detection sensor S3 (FIG. 5) for detecting the top (or bottom) and a sensor comprising a photo-interrupter of permeable type for counting the number of holes (the outlet sensor S2 and the inlet sensor S1 may cooperate to serve as this sensor), then the number of holes per page can be determined by dividing the counted number of holes by two. Thereafter, the CF sheet 38 may be returned to the original position by returning the sheet feed for the first several fed pages (F5).

When the information of the CF sheet 38 regarding the sheet supplying direction is obtained or when the operator inputs the number of holes per page via the operation portion, then a copying magnification rate is automatically calculated to select the maximum magnification among possible predetermined magnifications wherein all of the information can be included in an area of the transfer sheet except the edge margins (AMS). The size of the transfer sheet is automatically selected (APS)(F6). Further, a conveying speed of the CF sheet 38 is calculated in accordance with the magnification rate (F7), and the zoom lens 9 is set to a zoom position in accordance with a reduction rate (F8).

Then, it is determined whether the inlet sensor S1 is turned ON (presence of sheet) or not (F9). If the sheet is present, the CF sheet 38 is conveyed until the outlet sensor S2 is turned ON (F10). When the outlet sensor S2 is turned ON, the CF sheet 38 is conveyed in a reverse direction to return it until the inlet sensor S1 is turned OFF (F11). This is done for the heading of the CF sheet 38.

Then, when a copy start signal is inputted by depressing a copy start button (not shown) on the operation portion (F12), the sorter 25 is set to standby so that the transfer sheet is ejected on a lowermost sorter bin 25*a* or on an uppermost non-sort tray 25*b* of the sorter (F13). Then, the copy process operation of the copying machine is effected (F14), the illumination lamp 35 of the CFF 26 is turned ON (F15), and the pulse motor 26*a* of the CFF 26 is driven (F16) to count the number of sprocket holes (F17). After the main switch of the machine body 3 is turned ON, when the CFF 26 is first used, the potential control for the photosensitive drum 2*a* is effected.

As shown in FIG. 9, the information data on the CFF sheet 38 or original (first page, second page, . . . are shown by ①, ②, . . . respectively) is continuously read and exposure-scanned in the manner described above, with the result that the images corresponding to the information data are formed on the transfer sheets 41 as output sheets of the copying machine (first page, second page, . . . are shown by (1), (2), . . . respectively) successively. A sheet length or image forming area of each transfer sheet is shown by Lp and a normal sheet-to-sheet distance is shown by Lg. When the predetermined number of sprocket holes (corresponding to one page) is counted, it is determined that one page of the original has been scanned (F18).

Then, the CF sheet is conveyed by one pitch or by several pitches of the sprocket holes (F19). Meanwhile, if the inlet sensor S1 shows the absence of the CF sheet 38 (F20), the image formation process of the copying machine is stopped, thus finishing the image forming operation (F21). On the other hand, if the inlet sensor S1 shows the presence of the CF sheet 38, then the CF sheet is returned to the original position by conveying it back by one pitch or by several pitches (F22). Then, the aforementioned copy process operation of the copying machine is effected (F14). Thereafter, the above-mentioned operations are repeated until the inlet sensor S1 is turned OFF (i.e., until the CF sheet 38 becomes absent).

Next, the registration between a leading end of the CF sheet 38 or original (continuous sheet) and a leading end of the transfer sheet 41, and the movement of the transfer sheets 41 will be explained with reference to FIGS. 3 and 10. First, FIG. 3 shows the change in the conveying speed of the CF sheet 38. Due to the start-up property of the pulse motor 26*a* for driving the CFF 26, a time $t_{fr}$ (start-up time for the CF sheet 38) is required until the normal conveying speed of the CF sheet 38 and the process speed (V mm/s) of the copying machine are attained, and, at that point (point a), the conveying speed becomes V. From the point a to a point b, the CF sheet is controlled to convey at a constant speed of V.

At several 10 ms after the image forming area of the first page ① of the CF sheet 38, which is represented by (the number of sprocket holes per page x P)+($\frac{1}{2}$)P (where P denotes a pitch between the holes), has passed through the focusing position on the second glass platen 32, the conveying speed of the CF sheet is decreased by the pulse motor 26*a* (since reading of the image must be effected at the same speed). Incidentally, $t_{fd}$ indicates a time required to stop the CF sheet 38. In the illustrated embodiment, the reduction of the conveying speed is started at a point shifted to the right from the point b in FIG. 10 by+($\frac{1}{4}$)P and continues for P/2, with the result that the CF sheet is stopped at a position corresponding to a hole $H_{17}$. Then, the CF sheet is returned back for a time ($t_{rr}+t_{rd}$), thus returning the sheet by a length corresponding to P in FIG. 10 (to return the sheet by an amount required for the next start-up period of the motor and by an amount forwarded excessively) (F22) so that the sheet is stopped at a position corresponding to a hole $H_{16}$ for awaiting the second page. Thereafter, registration between the CF sheet and the transfer sheet 41 is effected, and the above-mentioned operations are repeated n times (for n pages) until the CF sheet 38 is absent (F20, F21 ).

As of in the timing chart shown FIG. 3, by inserting the times $t_{d1}$–$t_{dn}$ after the first to third pages, a time latitude is provided before the initiation of the conveyance of the CF sheet 38 from a fourth page, thus permitting the operator to check the images formed on the transfer sheets and to apply the initial folding habit to the CF sheet 38. The intervals of the times $t_{d1}$–$t_{dn}$ and the pages after which the times $t_{d1}$–$t_{dn}$ are inserted can be inputted by the operator optionally.

The procedure for inputting the times $t_{d1}$–$t_{dn}$ will be explained with reference to a flow chart shown in FIG. 6. First, the operator selects CFF mode setting items by depressing key(s) on the operation portion on the machine body 3 (M1). Then, the operator inputs the number of pages n after which the times $t_{d1}$–$t_{dn}$ are inserted via a ten-key pad (for example, n=3 seconds, $t_{d1}$–$t_{dn}$=-constant), or the interval of pause via the ten-key pad (M2). Then, it is determined whether the above-mentioned setting is finished or not; if the setting is finished, an OK key is depressed, whereas, if re-setting is desired, the procedure goes back to the step M2, where the same operation may be repeated (M3). Then, when the setting has been finished, the setting result is automatically stored in a RAM of the CFF control portion 29 (M4), and the next conveying operation for the CF sheet 38 is controlled by the set input value.

Further, as mentioned above, since the peripheral speed of the original convey roller 42 is slightly greater than that of the pin feed tractor 28, when the CF sheet 38 is conveyed at a downstream direction as shown in FIG. 5, the CF sheet is continuously read at the exposure station while applying the proper tension to the sheet. However, when the CF sheet 38 is conveyed at an upstream direction for the purpose of jam recovery, as shown in FIG. 7, the CF sheet may be excessively conveyed into a convey path 44, thereby causing undulation in the sheet. Now, a means for avoiding such inconvenience will be explained hereinbelow.

FIG. 8 shows the drive source for the CFF 26. In FIG. 8, the drive source includes a stepping motor 45, and belts 46, 47 are provided between the stepping motor 45 and a pulley **28*b* secured to a prismatic shaft 28*a* of the pin feed tractor 28, and between the stepping motor and a pulley 42*b* secured to a drive shaft 42*a* of the original convey roller 42, respectively. Further, a one-way clutch (transmission means) 48 for transmitting a driving force from the stepping motor 45 is disposed between the pulley 42*b* and the drive shaft 42*a*. The one-way clutch 48 is designed so that, only when it is rotated in a direction shown by the arrow D (i.e., only when the CF sheet 38 is conveyed in the downstream direction), it can transmit the driving force. Accordingly, if the CF sheet 38 is conveyed in the upstream direction as shown in FIG. 7, since the driving force from the stepping motor 45 is not transmitted, the original convey roller 42 acts as a driven roller, and the CF sheet 38 is not excessively conveyed into the convey path 44**, thus preventing any undulation, skew-feed and/or jamming of the CF sheet, thereby to improve the reliability of the apparatus.

When the sorter 25 is used as a means for handling the transfer sheet 41 to be ejected, a group mode is automatically selected to eject the transfer sheets 41 onto the sorter from the lowermost sorter bin **25*a* to next higher bin, in order. However, in the illustrated embodiment, a case where the transfer sheet 41 is ejected onto the uppermost non-sort tray 25*b*** will be explained.

When the transfer sheet 41 is ejected from the machine body 3 with a so-called "face-up" the CF sheet 38 is set so that the first page is first conveyed to feed the sheet from the first page in order. It is assumed that the maximum copy containing ability is, for example, 250 sheets, the CFF 26 is stopped by a soft counter in the copying machine after 250 sheets have been handled, and an alarm message such as "remove transfer sheets" is displayed on a display portion on the machine body 3. On the other hand, if the output device is a finisher stacker, when a number of transfer sheets are outputted corresponding to the maximum containing ability of a stack tray of then the finisher stacker, the CFF 26 is stopped as in the case of the sorter 25, and a similar alarm message is displayed.

Figure 11:
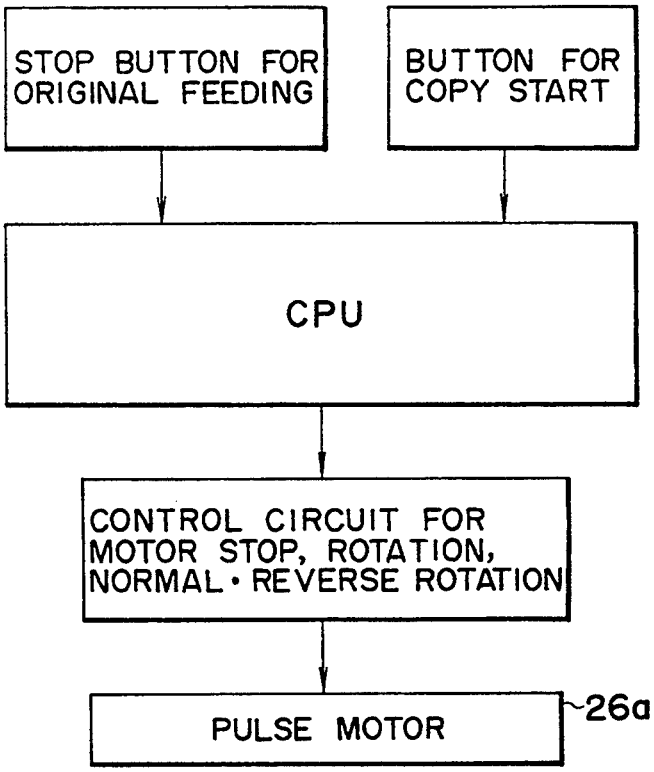
FIG. 11 is a block diagram for causing the temporary pause of original.

In the illustrated embodiment, the times $t_{d1}$, $t_{d2}$, $t_{d3}$, may be omitted and, alternatively, a pause capable of providing the temporary stop at any position may be provided (i.e., a stop button may be provided). Also in this case, the time latitude for checking the images formed on the transfer sheets 41 and for applying the initial folding habit to the CF sheet 38 can be obtained. When the images are good, the reading and image forming operations may be re-started by depressing the copy start button (FIG. 11).

On the other hand, if the images formed on the transfer sheets 41 are improper, a image density, magnification rate or the like is set again via the operation portion, and the CF sheet 38 is automatically conveyed back. Thereafter, the image forming operation is restarted by depressing the copy start button. In this way, by permitting the inspection of the images by interposing a pause, it is possible to greatly reduce the number of erroneous copies regarding the transfer sheets 41 in comparison with the case where the copying operation is effected from the beginning.

Figure 12:
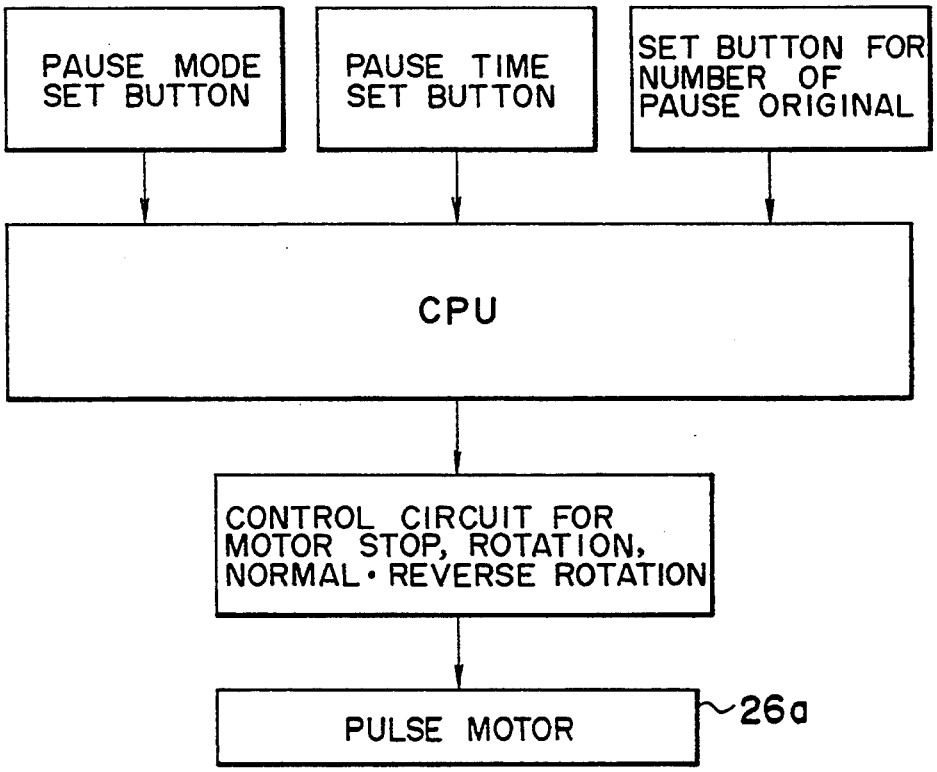
FIG. 12 is a block diagram for causing the temporary pause of the original according to another embodiment.

In another embodiment, the times $t_{d1}$, $t_{d2}$ may be omitted, and alternatively, a pause mode setting button may be provided. By this mode setting, after three pages of the original have been read the original may be stopped by the time $t_{d3}$. Thereafter, the reading of the fourth page of the original is started automatically. The interval of the time $t_{d3}$ can be changed by a timer. Of course, the original may be selectively stopped at any page. Further, after the time set by the timer has elapsed, the reading can be re-started by pressing the copy start button (FIG. 12).

In the above-mentioned embodiments, an example of the present invention has been illustrated with a continuous sheet conveyed as the original. However, the time intervals or pause may be inserted or interposed in an image forming operation, for forming images on a continuous sheet, thereby achieving the same effect.

What is claimed is:

1. A sheet original conveying apparatus for conveying a sheet original to a reading position where an image on the sheet original is read, comprising:

convey means for conveying a sheet original across a platen, images on the sheet original being read at a reading position while the sheet original is conveyed across the platen;

control means for controlling said convey means to convey the sheet original in a manner such that a first convey interval for a number of initial pages of the sheet original is greater than a second convey interval for remaining pages of the sheet original; and change means for changing a length of the first sheet convey interval.

2. A sheet original conveying apparatus according to claim 1, wherein said convey means includes means for conveying a continuous sheet original.

3. A sheet original conveying apparatus according to claim 2, wherein said means for conveying a continuous sheet original intermittently conveys the continuous sheet original page by page, and selectively conveys the continuous sheet original in a forward and a reverse direction.

4. A sheet conveying and reading apparatus for conveying a sheet original to a reading position where an image on the sheet original is read, comprising:

convey means for conveying a sheet original to a reading position;

reading means for reading at the reading position an image on a sheet original conveyed by said convey means;

a temporary stop button for temporarily stopping a conveyance of the sheet original; and a re-start button for re-starting conveyance and reading of a sheet original temporarily stopped by said temporary stop button.

5. A sheet original conveying apparatus according to claim 4, wherein said convey means includes means for conveying a continuous sheet original.

6. A sheet original conveying apparatus for conveying a sheet original to a reading position where an image on the sheet original is read, comprising:

convey means for conveying the sheet original to the reading position;

pause control means for automatically stopping a conveyance of the sheet original when a preset number of sheet originals have been conveyed, and thereafter for re-starting a conveyance of the sheet original after a predetermined time interval has elapsed; and means for setting the preset number of sheet originals.

7. A sheet original conveying apparatus according to claim 6 further comprising means for setting the predetermined time interval.

8. A sheet original conveying apparatus according to claim 5, wherein said means for conveying a continuous sheet original intermittently conveys the continuous sheet original page by page, and selectively conveys the continuous sheet original in a forward and a reverse direction.

9. An image forming apparatus having a sheet original conveying apparatus for conveying a sheet original to a reading position where an image on the sheet original is read, comprising:

convey means for conveying a sheet original across a platen, images on the sheet original being read at the reading position while the sheet original is conveyed across the platen;

control means for controlling said convey means to convey the sheet original in a manner such that a first convey interval for a number of initial pages of the sheet original is greater than a second convey interval for remaining pages of the sheet original;

change means for changing a length of the first sheet convey interval; and image forming means for forming a read image of the sheet original on a sheet member.

10. A sheet original conveying apparatus according to claim 9, wherein said sheet original conveying apparatus and said platen can be selectively used.

11. An image forming apparatus including a sheet original conveying and reading apparatus, for conveying a sheet original to a reading position where an image on the sheet original is read, comprising:

convey means for conveying a sheet original to a reading position;

reading means for reading at the reading position an image on a sheet original conveyed by said convey means;

a temporary stop button for temporarily stopping a conveyance of the sheet original;

a re-start button for re-starting conveyance and reading of a sheet original temporarily stopped by said temporary stop button; and image forming means for forming a read image of the sheet original on a sheet member.

12. An image forming apparatus having a sheet original conveying apparatus for conveying a sheet original to a reading position where an image on the sheet original is read, comprising:

convey means for conveying the sheet original to the reading position;

pause control means for automatically stopping a conveyance of the sheet original when a preset number of sheet originals have been conveyed, and thereafter for re-starting a conveyance of the sheet original after a predetermined time interval has elapsed;

means for setting the preset number of sheet originals; and image forming means for forming a read image of the sheet original on a sheet member.

13. A sheet original conveying apparatus as recited in claim 1, wherein said convey means intermittently conveys the sheet original.

14. A sheet original conveying apparatus as recited in claim 4, wherein said convey means intermittently conveys the sheet original.

15. A sheet original conveying apparatus as recited in claim 6, wherein said convey means intermittently conveys the sheet original.

16. An image forming apparatus as recited in claim 9, wherein said convey means intermittently conveys the sheet original.

17. An image forming apparatus as recited in claim 11, wherein said convey means intermittently conveys the sheet original.

18. An image forming apparatus as recited in claim 12, wherein said convey means intermittently conveys the sheet original.

19. A sheet original conveying apparatus for conveying a sheet original to a reading position where an image on the sheet original is read, comprising:

conveying means for conveying a sheet original across a platen, images on said sheet original being read at a reading position while the sheet original is conveyed across the platen;

control means for controlling said convey means to convey the sheet original in a manner such that a first convey interval for a number of initial pages of the sheet original is greater than a second convey interval for remaining pages of the sheet original; and change means for changing a number of initial pages to be conveyed.

20. An image forming apparatus for forming an image on a sheet original by reading it during conveyance thereof, comprising:

convey means for conveying a sheet original across a platen, images on said sheet original being read at a reading position while the sheet original is conveyed across the platen;

control means for controlling said convey means to convey the sheet original in a manner such that a first convey interval for a number of initial pages of the sheet original is greater than a second convey interval for remaining-pages of the sheet original;

change means for changing the number of initial pages to be conveyed; and image forming means for forming an image on the sheet original conveyed by said convey means.

* * * * *

UNITED STATES PATENT AND TRADEMARK OFFICE

CERTIFICATE OF CORRECTION

PATENT NO. : 5,448,345
DATED : September 5, 1995
INVENTOR(S) : NOBUTAKA UTO, ET AL.

It is certified that error appears in the above-indentified patent and that said Letters Patent is hereby corrected as shown below:

Figure 2B,
"SORTOR" should read --SORTER--, and "LUMP" should read --LAMP--.

Column 1,
line 58, "feeding" should read --the feeding--.

Column 2,
line 37, "as" should be deleted; and
line 52, "First of all," should read --First,--.

Column 3,
line 14, "re-feeding" should read --for re-feeding--.

Column 4,
line 29, "mal-function" should read --malfunction--.

Column 6,
line 51, "As of in" should read --As in--, and "shown" should read --of--.

Column 7,
line 51, " "face-up" " should read --face-up,"--.

Column 9,
line 22, "claim 6" should read --claim 6,--.

Claim 10,
line 61, "remaining-pages" should read --remaining pages--.

Signed and Sealed this

Nineteenth Day of March, 1996

Bruce Lehman

*Attest:*

BRUCE LEHMAN

*Attesting Officer*

*Commissioner of Patents and Trademarks*